United States Patent [19]

Welch

[11] 4,244,347

[45] Jan. 13, 1981

[54] PORTABLE DEVICE FOR SHAPING THE PERIPHERY OF SANDING WHEELS

[75] Inventor: Alphonso K. Welch, High Point, N.C.

[73] Assignee: Abrasives & Air Equipment Co., High Point, N.C.

[21] Appl. No.: 7,333

[22] Filed: Jan. 29, 1979

[51] Int. Cl.[3] ..... B24B 53/08

[52] U.S. Cl. ..... 125/11 PH; 144/144 R

[58] Field of Search ..... 125/11 R, 11 TP, 11 PH, 125/11 P; 144/144 R

[56] References Cited

U.S. PATENT DOCUMENTS

| | | | |
|---|---|---|---|
| 2,133,191 | 10/1938 | Danner | 125/11 TP |
| 2,150,091 | 3/1939 | Alvord | 125/11 PH |
| 2,365,302 | 12/1944 | Shutt | 125/11 TP |
| 2,469,255 | 5/1949 | Barnes | 125/11 PH |
| 2,602,437 | 7/1952 | Tancred | 125/11 PH |
| 2,884,025 | 4/1959 | Fales | 125/11 TP |
| 3,187,736 | 6/1965 | Adamczyk | 125/11 R |
| 3,276,489 | 10/1966 | Little | 144/144 R |

*Primary Examiner*—Harold D. Whitehead

[57] ABSTRACT

A portable profile shaping device is positioned on a table beside the shaft of a spindle sander having a rotary sanding wheel to be shaped mounted thereon. As the device is activated a shaping tool is manually moved in an axial direction along the surface of the rotating sanding or grinding wheel. Simultaneously the tool is automatically adjusted radially responsive to a follower arm which follows the pattern or contour of a wooden molding piece of a shape for which the grinding or sanding wheel is being cut. A hydraulic cylinder activates the radial movement of the shaping tool. The fluid for the hydraulic cylinder is controlled by a valve which is mechanically connected or linked to the follower arm for controlling the flow of fluid to the hydraulic cylinder responsive thereto. The sanding wheel is actually shaped while mounted on the same spindle on which it is going to be used for sanding subsequent molding strips so that misalignment of the wheel is prevented. Such misalignment can occur because of the movement of the sanding wheel from one spindle to another.

1 Claim, 3 Drawing Figures

PORTABLE DEVICE FOR SHAPING THE PERIPHERY OF SANDING WHEELS

BACKGROUND OF THE INVENTION

In the woodworking industry the formation of contoured or shaped pieces such as molding and the like are often necessary. As one operation in the fabrication of such pieces, it is necessary to finish sand or grind the shaped piece to prepare it for painting or finishing. In accomplishing such a step there is utilized a generally circular sanding or abrading wheel which has the periphery thereof shaped as a mirror image of the piece of molding to be sanded. The wheel is placed on a vertically oriented spindle, commonly called a spindle sander, and the strip of wood to be sanded or ground is moved in a generally tangential path adjacent the periphery of the rotating wheel.

There are literally hundreds of peculiar shapes of molding which must be sanded by a typical furniture plant, and therefore the plant must carry or be able to fabricate an equal number of sanding wheels each with a peripheral surface configuration corresponding to one of the molded shapes. In conventional practice, in order to form these sanding wheels a blank stone or wheel is rotated on a lathe or other spindle and a highly skilled workman manually operates a shaping tool to form the contours on the surface of the wheel in accordance with a drawing or sample piece of molding. This is mainly done by an eye to eye comparison which requires considerable skill on the part of the craftsman and many hours, thus making the formation of such a sanding wheel very expensive.

One attempt to eliminate the manual approach and the requirement for skilled craftsmanship was unsuccessfully attempted by the assignee within the last several years. This attempt included a machine table with a motor mounted on the upper surface thereof with a horizontally extending shaft and a tool which was moved along the surface of the wheel and simultaneously moved radially thereof to form the peripheral surface of the sanding wheel in accordance with a sample profile. This device was similar to a profile lathe. Several problems existed with this embodiment which could not be overcome and as a result the attempt failed. One problem was that the size and cost of the self contained unit was prohibitively expensive. Further, the connecting linkage between the sample profile and the tool activating mechanism resulted in inaccuracies. Also when the sanding wheel was removed from the spindle of the profile lathe device then repositioned on the spindle sander, variances in the mounting of the spindle for cutting, then repositioning for sanding resulted in many unsatisfactory work pieces.

SUMMARY OF THE PRESENT INVENTION

The present invention is directed to a portable device which is mounted and carried on its own platform and includes only the tool and the mechanism necessary for advancing the tool radially as it is moved vertically. The sanding wheel is mounted on the spindle of a conventional spindle sander with which it will ultimately be used in the sanding operation. The portable shaping device is carried to and set on the existing table of the spindle sander with the tool so aligned with respect to the work piece that it is moved radially thereof in accordance with a prescribed pattern as it is simultaneously moved axially along the periphery of the wheel.

The tool is activated in a radial direction by a linear actuator such as a hydraulic cylinder. Both the hydraulic cylinder and the tool are mounted on a housing which is manually movable in a vertical path or a path parallel to the axis of the spindle as a result of the housing being mounted on a pair of vertical support rods. At the rear end of the platform there is a bracket for mounting or supporting a piece of sample molding thereon, the configuration or profile of which is to be cut into the sanding wheel by the device. A spring biased follower arm is mounted for movement with the aforementioned housing relative to the stationary piece of molding so that as the housing is raised and lowered the follower arm is caused to follow the contour or profile of the molding surface. The follower arm is in turn mechanically connected or linked to a rotatable fluid control valve which is placed in the fluid line between a reservoir and the hydraulic cylinder. As the valve is activated or adjusted responsive to the movement of the follower arm, the flow of fluid is controlled to the cylinder which in turn controls the radial movement of the work tool against the sanding wheel.

In this way, as the housing is moved up and down on the platform the work tool is caused to move radially with respect to the sanding wheel which is rotating on its own spindle and the desired shape is cut into the peripheral surface of the wheel.

It is therefore an object of the present invention to provide a portable device for shaping the peripheral surface of a sanding wheel which is in turn to be used for finish sanding or grinding the surface of a piece of wooden molding.

It is another object of the present invention to provide a portable device of the type described which may be utilized with the sanding wheel while mounted on the spindle of the spindle sander in which it will be used to perform its sanding work once the shaping operation has been completed.

Other objects and a fuller understanding of the invention will become apparent upon reading the following detailed description of a preferred embodiment along with the accompanying drawings in which.

DETAILED DESCRIPTION OF A PREFERRED EMBODIMENT

Figure 1:
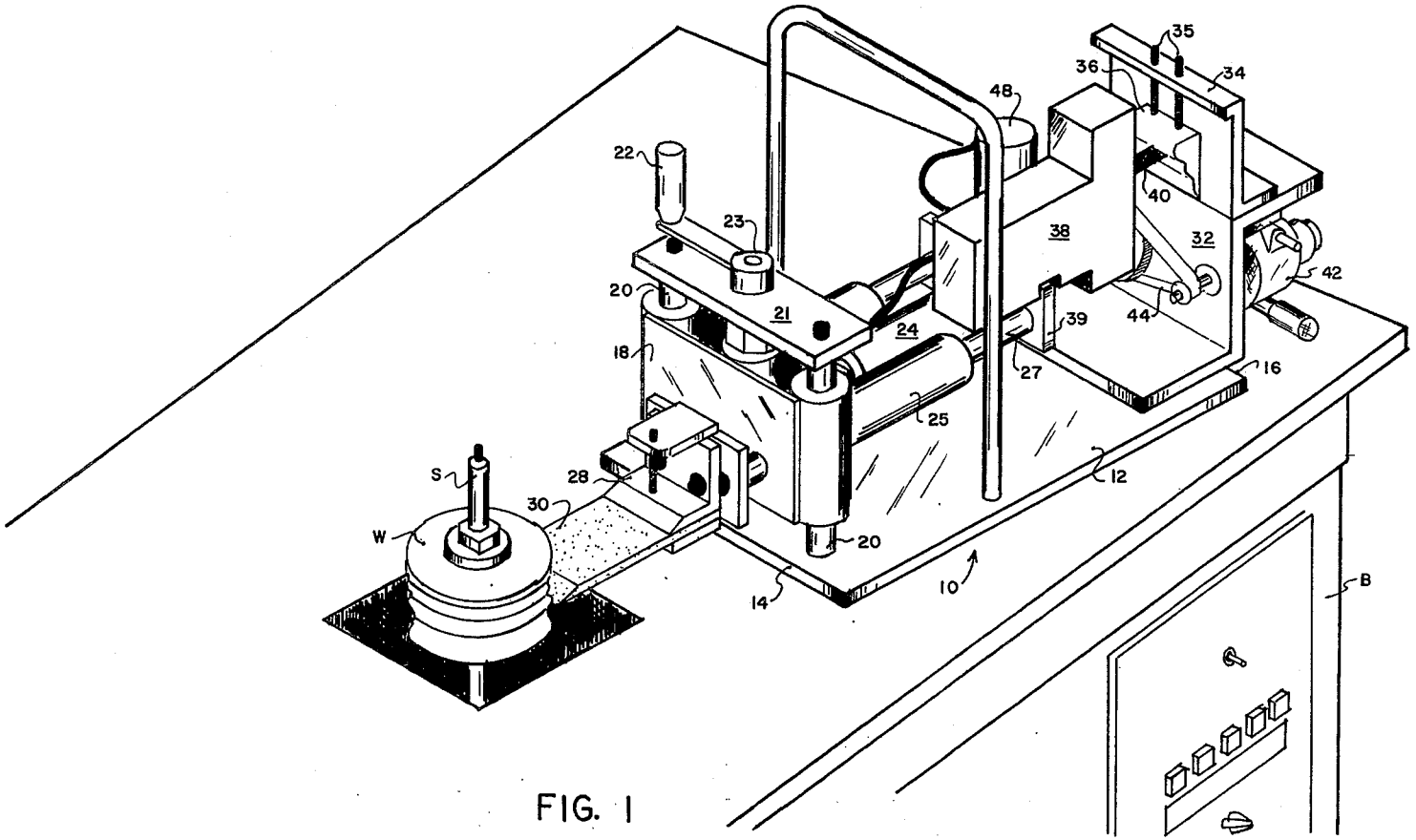
FIG. 1 is a perspective view illustrating the device according to the present invention as set up on the surface of a spindle sander adjacent a sanding wheel which has just been shaped.
Figure 2:
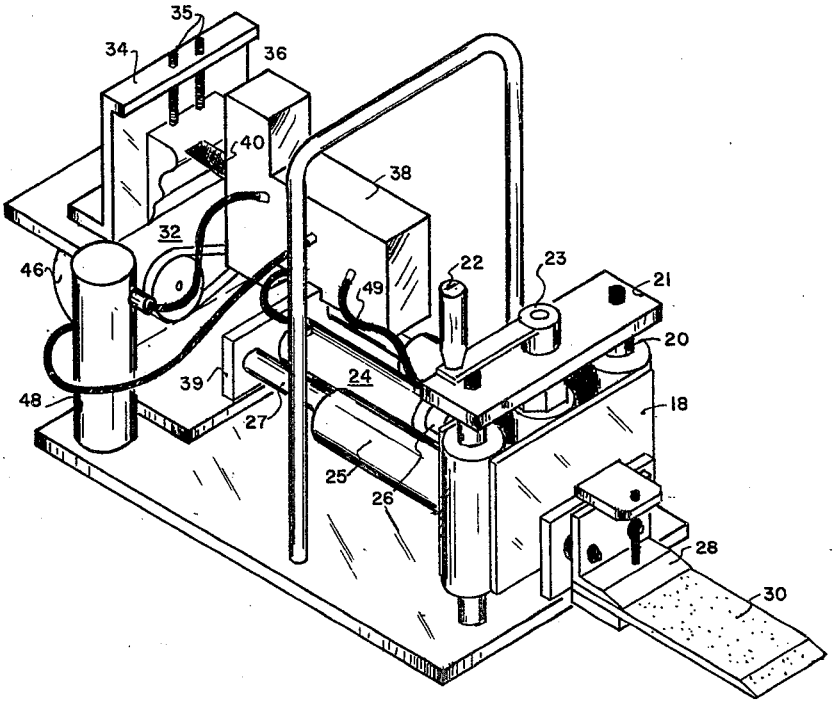
FIG. 2 is a perspective view of the device, similar to FIG. 1 except looking at the opposite side thereof.

Turning now to the drawings, there is illustrated in FIGS. 1 and 2 the portable device 10 as it is positioned on a conventional spindle sander B which includes a rotatable spindle S extending vertically upward from the top surface thereof onto which a blank sanding wheel W is mounted for operative rotation. Sanding wheel 10 is formed of a conventional material for sanding wheels such as a carbide resin, polyurethane resin with garnet silica carbide therein, or other similar materials. Normally when used as a sander the wheel is rotated while a molding strip desired to be sanded is moved tangentially across the peripheral surface of the wheel W thereby providing the sanded finish desired to the molding strip.

In accordance with the present invention, after a new blank wheel is mounted on the spindle S, the portable device 10 is carried to and positioned on the upper surface of the spindle sander D prior to the time the wooden strips are being processed thereon. The purpose of the portable device 10 is to cut a desired contour into the periphery of the wheel W using a sample of the molding strip 36 as a guide, so that the periphery of the sanding wheel W is provided with a mirror image of the contoured surface or profile of the sample block 36. Toward this end, in general, a tool 30 (stone, diamond or other material) is caused to move radially with respect to the rotating wheel W as the tool is simultaneously moved axially of the wheel while supported on the housing 18. A mechanical linkage means connects tool 30 with the sample molding strip, and includes a linear actuating means such as a hydraulic cylinder 24 to support the work tool 30 and activates it backwardly and forwardly in a radial direction responsive to the movement of a follower arm 40, which at all times is in engagement with the profile of the sample molding strip 36 as both the arm 40 and the work tool 30 are moved vertically. As can thus be seen the skill of the workmen required to accomplish the shaping of the wheel W is greatly minimized from what would be the case if the wheel had to be formed manually.

Turning now to the details of the construction the portable device 10 includes a platform 12 having a forward end 14 and a rear end 16, the forward end 14 being the end nearest to the wheel W desired to be shaped. A housing 18 is mounted for vertical reciprocal movement on a pair of support or guide rods 20 which in turn are secured to the surface of the platform 12 and extend upwardly therefrom adjacent the front end 14 thereof. A mounting plate 21 is secured to the upper ends of guide rods 20 and extends across the space therebetween. A hand crank 22 rotates a rotatable threaded rod 23 which extends down from plate 21 into a correspondingly threaded opening in the housing for movement of the housing 18 in a vertically reciprocal path parallel to the axis of rotation of the spindle S.

A hydraulic cylinder 24 is attached to housing 18 and extends rearwardly therefrom while the piston 26 thereof extends forwardly through an opening in housing 18. For stability, rearwardly extending sleeves 25 slide on horizontal guide rods 27. A bracket means 28 is attached to the free end of piston 26 for removable mounting of the work tool 30. This is merely one conventional means for mountings a work tool 30 and other equivalent mounting are obviously within the scope of this invention.

A second, stationary bracket 32 extends upwardly from a point near the rear end 16 of platform 12 to provide a support for the sample holding clamp 34. The strip of wooden molding 36 taken from the sample to be processed by wheel W is clamped into the clamping means 34 by set screws 35 in contemplation of forming the peripheral surface of sanding wheel W.

Figure 3:
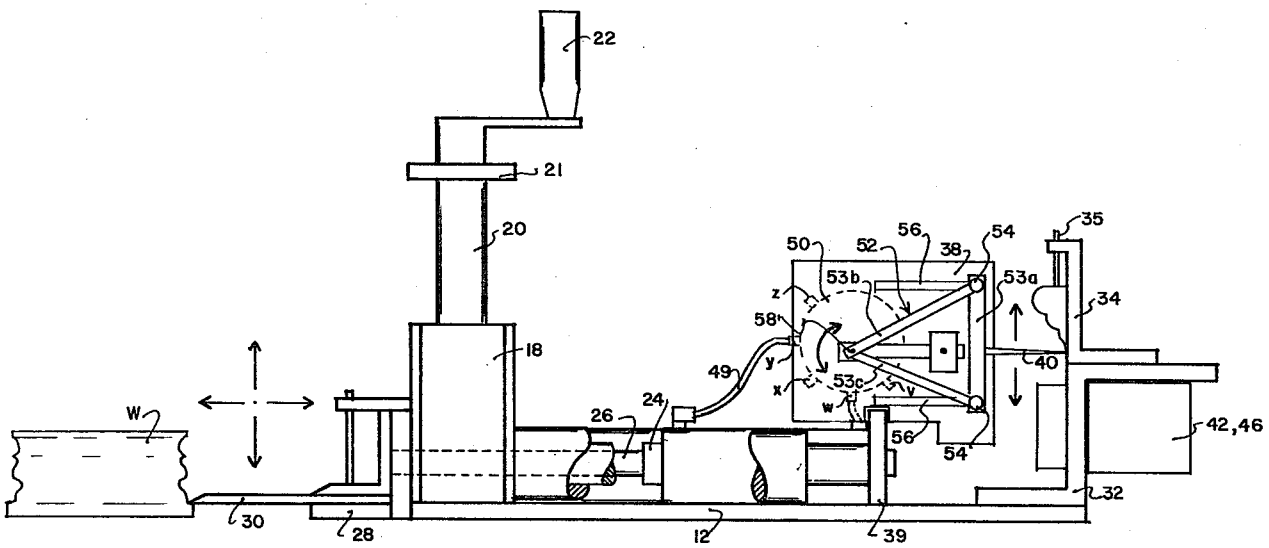
FIG. 3 is a schematic representation of the control system of the present invention.

A control housing 38 is attached to the rear end of hydraulic cylinder 24 by means of a support bracket 39 so that control housing 38 is movable in a vertical reciprocal direction along with housing 18. A follower arm 40 protrudes rearwardly from control housing 38 and is spring biased into continuous engagement with the profile or surface configuration of the block 36. As illustrated in FIG. 3 the follower arm 40 is mounted for horizontal linear reciprocation responsive to pressure against the end of the follower arm by the profile of block 36 with the opposite end of the arm 40 being mechanically linked to valve 50 to control the flow of hydraulic fluid from a reservoir 48 into the hydraulic cylinder. It should be recognized that a motor 42 and a pump 46 mounted to the second bracket 32 maintain pressure on the fluid in reservoir 48 at all times, and the flow of fluid through the lines 49 to the hydraulic cylinder is controlled solely by valve 50 responsive to the movement of arm 40 along the surface of the sample molding strip 36.

Valve 50 may be one of many different types; however, one type that has been found to work satisfactorily is a rotary valve illustrated schematically in FIG. 3, and is commercially available as the "Microtork" valve, a trademark of Microtork, Inc., Redbank, New Jersey. Further as illustrated in FIG. 3, the mechanical linkage between follower arm 40 and valve 50 includes a triangular framework or yoke 52. One side **53*a* of the yoke includes a pair of spaced rollers or pins 54 extending outwardly for support on a rail or track 56, thereby facilitating the reciprocal movement of the yoke 52. The other two sides 53*b*,53*c* of yoke 52 are pivotally connected at their extremities to the opposite ends of side 53*a* and to each other at an apex. Further the apex is attached to a pin 58 on valve 50 offset from the center. Otherwise valve 50 is mounted for rotation within control housing 38 about its axis which is perpendicular to the path of movement of arm 40. Therefore as yoke 52 is caused to move back and forth the pin 58 is moved arcuately causing valve 50 to pivot about its axis. A plurality of ports v,w,x,y and z are in the periphery of valve 50, ports w and y being connected to conduits heading to opposite ends of hydraulic cylinder 24, port x being connected to the input from hydraulic fluid reservoir 48, and ports v and z being connected to receive the return flow of fluid from the opposite end chambers of the hydraulic cylinder. As the housing valve 50 is rotated, the flow of hydraulic fluid through ports w and y is varied precisely making for very fine adjustments in the movement of the piston 26 of hydraulic cylinder 24**. This provides the accuracy necessary to accomplish the cutting of the wheel W.

Yoke 52 is normally spring biased to the extreme right position in FIG. 3, indicative of a zero setting with the follower arm having no pressure thereagainst and the work tool 30 being completely retracted.

In operation a blank or uncut sanding wheel W is placed on the vertical spindle S and secured thereon in the same position in which eventually wooden molding strips will be passed thereby for sanding. The portable shaping device 10 is mounted on the surface or table of the spindle sander housing B with the work tool 30 retracted and housing 18 in its lowermost position. A sample piece of wood having the surface contour of the type desired to be formed into the sanding wheel W is placed in the clamping device 34 and secured. As the shaping device 10 and the spindle S are activated, pump motor 42 begins pumping of the hydraulic fluid. The crank arm 22 is turned to begin to raise the housing 18. As the follower arm 40 engages the surface of the sample block of wood 36 the work tool 30 is caused to move radially against the periphery of the rotating sanding wheel and begin its shaping of the surface. As the follower arm 40 continues along the profile of the sample block of wood 36 the movement of the arm 40 causes continual modulation of valve 50 so that the fluid flow to the hydraulic cylinder 24 is varied responsively and the radial position of the tool 30 adjusted to effect the cutting of the sanding wheel to the described configuration.

While a preferred embodiment of the invention has been shown and described in detail hereinabove, it is obvious that various changes might be made in certain of the components and the arrangement of the parts without departing from the scope of the invention which is set forth in the following claims.

What is claimed is:

1. A portable shaping device for forming the periphery of a sanding wheel into a shape corresponding to the profile of a piece of wooden molding while mounted on the spindle of a motor in its sanding position, said shaping device comprising:

(a) a platform of such size and shape that it is selectively and manually moved from one conventional spindle sander to the table of another spindle and situated in an operative position thereon;

(b) a housing means mounted on said platform and means for manual movement thereof in a path parallel to the axis of rotation of said sanding wheel;

(c) a hydraulic cylinder attached to and carried by said housing means for axially reciprocal movement therewith, the piston of said hydraulic cylinder attached to and carried by said housing means for axial reciprocal movement therewith, the piston of said hydraulic cylinder positioned for movement in a radial direction with respect to said sanding wheel when said platform is in an operative position;

(d) a shaping tool attached to the free end of the piston of said hydraulic cylinder for radial movement therewith;

(e) holding means fixed with respect to said platform for securing said piece of wooden molding;

(f) a follower arm carried by said housing means and spring biased into engagement with the contoured surface of said piece of wooden molding, said follower arm being axially movable with said housing means, said follower arm being slidably movable against the spring biase in a radial direction responsive to pressure against said follower arm during axial movement of said housing means, whereby said radial sliding movement follows the shape of said molding;

(g) a source of hydraulic fluid and pump means for providing a flow thereof from said source to said hydraulic cylinder, a valve means positioned exteriorly of said hydraulic cylinder and in the path of fluid flow to said hydraulic cylinder, said valve means including a rotatable housing with a plurality of valved ports and said valve means transforming the linear movement of said follower arm to a fluctuation in fluid flow to said hydraulic cylinder;

(h) said rotatable housing being mounted for rotation within said control housing with the axis of rotation extending perpendicularly to the linear horizontal path of movement of said follower arm, a yoke attached to said follower arm for horizontal reciprocal movement therewith, said yoke including a triangular frame with two adjacent sides pivotally attached to the third side and to each other at an apex, said third side forming the portion of said yoke which is attached to said follower arm, and said apex being attached to said rotary valve at a point on the face thereof which is removed from the axis of rotation, whereby the flow of fluid to opposite ends of the hydraulic cylinder may be modulated and movement of said follower arm translated into rotary motion of said valve, and whereby said shaping member is caused to move radially of said sanding wheel responsive to axial movement of said housing means.

* * * * *